United States Patent [19]

Williams

[11] 4,390,024

[45] Jun. 28, 1983

[54] MATERNITY BRASSIERE

[76] Inventor: Marguerite R. Williams, 443 W. 44th St., New York, N.Y. 10036

[21] Appl. No.: 346,391

[22] Filed: Feb. 5, 1982

[51] Int. Cl.[3] ..... A41C 3/04

[52] U.S. Cl. ..... 128/460

[58] Field of Search ..... 128/460, 442

[56] References Cited

U.S. PATENT DOCUMENTS 2,317,664 4/1943 Becker et al. ..... 128/460

2,613,355 10/1952 Coleman ..... 128/460

*Primary Examiner*—Doris L. Troutman

[57] ABSTRACT

A maternity brassiere consisting of wide stretchable bands of material enclosing the outer upper periphery of each breast which act in conjunction with detachable inner cup sections which overlay the inner portions of said wide stretchable bands, adjustable means attached to the apices of said wide stretchable bands and said inner cups in such manner as to result in variation in the total cup size when the aforementioned two elements are attached at any one of several points of the adjustable means, said total cup size being either increased or decreased to conform to variations in the breast size of the wearer during pregnancy and after birth, and detachable means which allow exposure of the breasts for infant nursing.

4 Claims, 7 Drawing Figures

MATERNITY BRASSIERE

This invention concerns maternity or nursing brassieres, in which two partially detachable breast pockets can be opened individually for the purpose of nursing an infant.

The present invention has as its primary object the practical design of a maternity brassiere which provides multiple adjustable means of such a nature that after the brassiere has been fitted to the correct size of the wearer during her pregnancy, said adjustable means can be easily manipulated by the wearer to accommodate an increase in the breast size during advanced pregnancy by such adjustable means as well as accommodating a decrease in breast size occurring after birth.

The variation in bra cup size of the present invention also permits the nursing mother easy and swift adjustment with one hand of the bra cup size by adjusting the multiple attaching means upward or downward to achieve a larger or smaller smooth-contoured total bra cup by means of the two separate elements of the present invention working together to form said total bra cup. Thus the nursing mother may have the bra cup size adjusted to fit her larger breast size before nursing the infant, and after nursing to easily and with one hand attach the inner cup back onto the wide outer band to achieve a smaller cup size to conform to her smaller breast size after nursing.

Such adjustable means therefore provide variations in the volume of the cup size which may be either greater or lesser than the cup size for which the wearer was fitted at the period of her pregnancy when said maternity brassiere was purchased, this obviates the necessity of buying several brassieres during this period of variation in the wearers breast size during her period of pregnancy and after birth, since the brassiere of the present invention will efficiently perform the function of a smaller, medium and larger size brassiere.

Therefore another object of the invention is to provide a maternity brassiere which will in effect be the equivalent of three different brassieres of smaller, medium and larger sizes which the wearer may be obliged to purchase during her period of pregnancy and after birth, with considerable monetary savings to the individual involved.

The development in recent times of new stretchable fabrics has led to novel and improved constructions of garments, which perform in ways which were impossible to attain with the older non-stretchable materials.

The present invention relies on such modern stretchable materials to achieve its aims by providing a variable bra cup size consisting of two elements working in concert to achieve such a variable cup size, one element consisting of wide outer bands of stretchable material encircling the upper periphery of each breast and an inner cup of stretchable or non-stretchable material overlaying the inward portion of each of said wide stretchable bands and being attached by multiple means to said bands only at the upper apices of said bands and said inner cups, such attaching means of the inner cup to the wide stretchable bands at said apices resulting in a smooth-fitting total cup size which may be enlarged or reduced in size by changing at will the position of the attaching means of the inner cups relative to the position of the attaching means on the apices of the stretchable wide outer bands.

It will be understood that in order to perform the function of varying the total cup size by the cooperating action of these two bra cup elements, the two elements are permanently attached to a conventional body-encircling band of material in the front area of the brassiere and along the lower front region of said body-encircling band.

Most maternity brassieres have been designed with detachable means at the front shoulder strap point for the purpose of uncovering the breast for infant nursing. Some prior art has also used additional detaching means in the center front of the brassiere to give additional exposure of the breast. Brassieres in prior art have also been constructed which include a multiple adjustment of the detachable means, but the result has been to give more or less breast coverage but not the smooth and shapely fit which is a necessary requirement of a well-designed brassiere. The concept of multiple attaching means has been used extensively in garments of prior art to achieve a variety of constructions, and such multiple attaching means alone are not novel.

In prior art such multiple attaching means have merely let the brassiere cup slide upward or downward in vertical adjustment, resulting in an ill-fitting looseness of the brassiere cup or conversely in a flattening and tightening effect as opposed to a proper-fitting brassiere.

While the action for adjustment of the brassiere cup size is also controlled vertically in the present invention, the result of such vertical action is to achieve an increase or decrease in the total volume of the brassiere cup which is composed of the two essential elements, the wide outer bands of stretchable material and the inner cups acting in concert thereof.

In most maternity brassieres which are fitted on the wearer at the time of her pregnancy, standard adjustments are provided in the rear of the body-encircling band of the brassiere and in the length of the shoulder straps. Those brassieres in prior art which have attempted to give additional adjustment in the brassiere cup size itself have proven totally ineffective in achieving a variable cup size of increased or decreased volume and smooth-fitting contour.

In addition to the multiple attaching means for the purpose of increasing or decreasing the total brassiere cup size described herewith and shown in the drawing, the scope of the present invention is not to be restricted to such means, but can be one of many systems of fasteners well known in the art, such a VELCRO, hooks and eyes, snaps, buttons etc.

These and other advantages and features of the invention will be more readily apparent from a detailed description of the drawing thereof in which:

FIG. 1 is a front elevational view in perspective of a preferred embodiment of the invention;

FIG. 1-A is a front elevational view in perspective of a portion of the embodiment of the invention depicted in FIG. 1 showing the attaching means located at the highest point of attachment, resulting in a smaller overall cup size than shown in FIG. 1;

FIG. 1-B is a front elevational view in perspective of a portion of the embodiment of the invention depicted in FIG. 1 showing the attaching means located at the lowest point of attachment resulting in a larger over-all cup size than shown in FIG. 1;

FIG. 2 is a sectional view showing in combination sections 5—5, 6—6 and 7—7 which clearly illustrate the variation in cup size achieved by the multiple attaching means, 6—6 being the normal cup size of the brassiere in which the attaching means are located in the middle attaching position, 5—5 being the largest cup size of the brassiere in which the attaching means are located in the lowest attaching position, and 7—7 being the smallest cup size of the brassiere in which the attaching means are located in the highest attaching position; for purposes of clarity, only the outer edge of band 1 is shown in the three positions;

Figures 1, 2, 3, 4, 5:
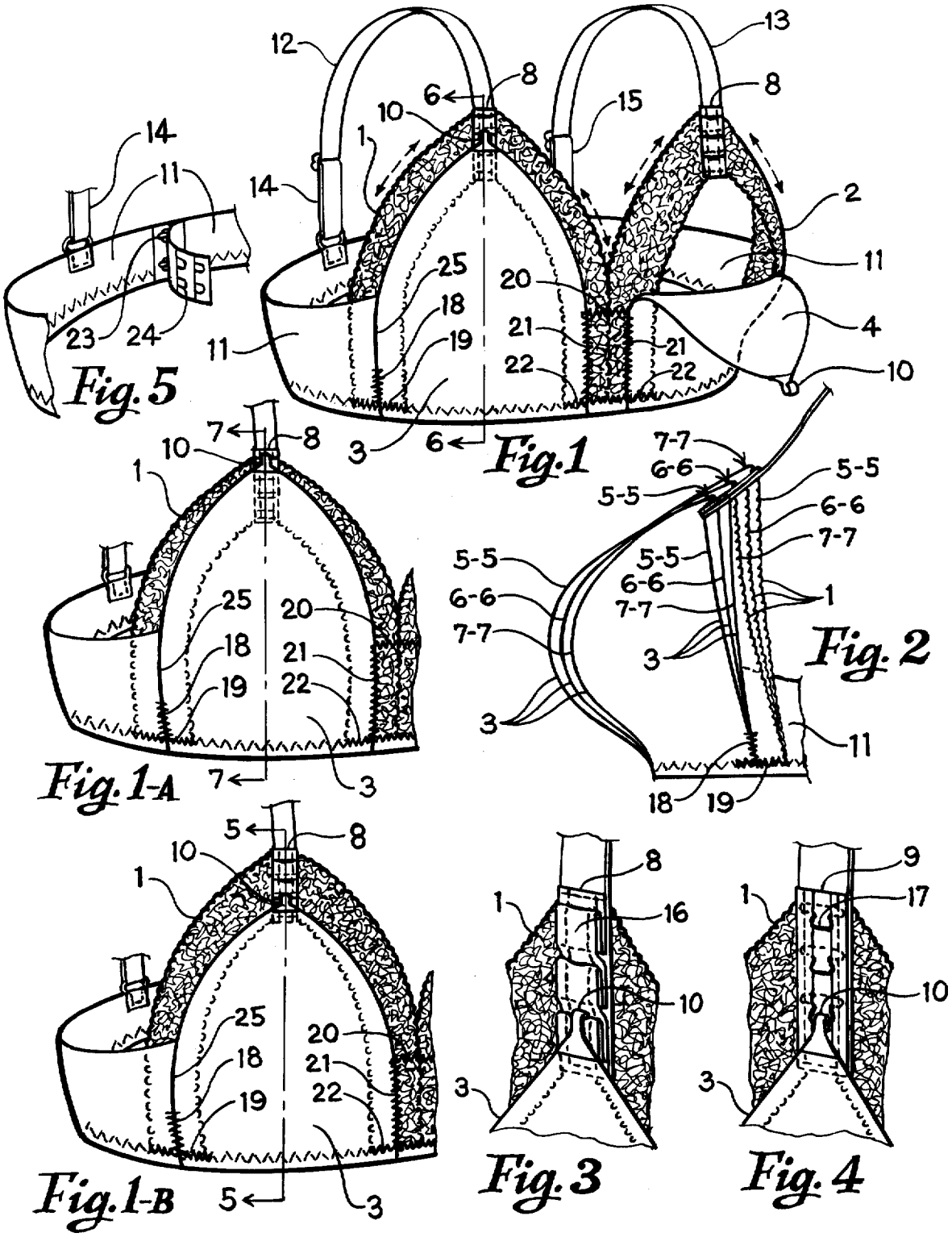
FIG. 3 is an enlarged perspective view showing a preferred embodiment of the multiple attaching means.
FIG. 4 is an enlarged perspective view showing one of many possible alternative multiple attaching means.
FIG. 5 is a view showing the multiple adjustment in the rear of the body-encircling band.

Referring more particularly to the drawing, the maternity brassiere construction of the present invention includes a body-encircling band 11 consisting of two panels which terminate in the rear of the band in multiple adjustments of hooks 23 and eyes 24 as shown in FIG. 5. The other ends of the panels of body-encircling band 11 are attached to the inner bra cups 3 and 4 on each side of the brassiere at 25, as shown in FIGS. 1, 1-A and 1-B. The inner brassiere cups 3 and 4 and the wide outer bands of stretchable material 1 and 2 are sewn together on the side bottom area of the brassiere as shown by 18 and 19, and at the center bottom area of the brassiere as shown by 20, 21 and 22.

Since the wide stretchable outer bands and the inner cups of the present maternity brassiere each have a total combined right-side cup composed of 1 and 3, and a total combined left-side cup composed of 2 and 4, said right-side and left-side total cups are mirror images of each other in configuration and construction, therefore the detailed descriptions and illustrations of the variation in cup size constituting the patentable novelty of the present invention have been shown as applied to the right-side cup only for purposes of clarity, as indicated in FIGS. 1, 1-A and 1-B and in FIG. 2.

Conventional shoulder straps 12 and 13 are attached to the right and left rearward portions of body-encircling band 11 and elastic sections 14 and 15 are provided at such points of attachment to allow adjustment in the length of said shoulder straps 12 and 13.

The other and front end of shoulder strap 12 is permanently attached to the apex of the stretchable wide outer band 1, and the front end of shoulder strap 13 is permanently attached to the apex of the stretchable wide outer band 2. The wide outer bands 1 and 2 covering the outer and upper periphery of each breast of the wearer is constructed of stretchable material, either with elastic fibers, such as "stretch" lace and power knits; or with a non-elastic but stretchable fiber, such as knits, tricots of all types, and materials made of stretchable yarn, for example, those with a high twist.

Inner cups 3 and 4 are constructed to partially overlay outer bands 1 and 2 in the inward areas of said outer bands 1 and 2. The inner cups 3 and 4 may be fabricated of a single molded or contoured piece of material, or of multiple panels stitched together in conventional fashion. Inner cups 3 and 4 may also be of either stretchable or non-stretchable material.

In FIG. 1 the left-side inner cup 4 is shown detached from the multiple attaching means 8 in order to expose the breast of the wearer for infant nursing. Since the right side of the brassiere construction is a mirror-image of the left side, inner cup 3 may be detached in the same manner from the multiple attaching means 8 for the aforesaid purpose of infant nursing. Multiple attaching means 8 are permanently affixed to the apices of the wide stretchable outer bands 1 and 2 and consist in the preferred embodiment shown in FIGS. 1, 1-A and 1-B of a series of receiving pockets into which hooks 10 permanently affixed to the apices of inner cups 3 and 4 may be inserted for attachment of said inner cups 3 and 4 to stretchable bands 1 and 2, as well as being detached for infant nursing.

As clearly shown in FIGS. 1, 1-A and 1-B the new and novel feature of the present invention is comprised of the partial overlay of inner cups 3 and 4 onto the inward areas of outer stretchable bands 1 and 2 in varying degrees of such overlaying action resulting from the attachment of hooks 10 to the multiple attaching means 8 in any one of several attaching positions. The construction of the total cup consisting of the attaching means of the inner cups to the multiple attaching means of the wide outer bands of stretchable material operates in a somewhat similar manner to the opening and closing of a camera lens in that a variable depth of greater or lesser volume is maintained with the adjustment of the inner cups to the wide outer stretchable bands through the multiple attaching means.

In FIG. 1 the right-side cup portion of the maternity brassiere indicates the inner cup 3 overlaying the inner portion of the wide outer band 1 in a median position relative thereto, by the positioning of attaching hook 10 on the apex of inner cup 3 onto the multiple attaching means 8 permanently affixed to the apex of outer band 1 in a central attaching position, thus having one attaching position of the multiple attaching means located above said central attaching position and another attaching position located below said central attaching position. FIG. 1-A shows inner cup 3 overlaying a greater portion of the inner area of the wide stretchable outer band 1 due to the positioning of attaching hook 10 onto the topmost attaching position of the multiple attaching means 8 of band 1, resulting in a smaller volume and total cup size of the two elements 1 and 3 than that shown in FIG. 1. Wide outer band 1 is thus exerting a diminished degree of stretchability to act in concert with inner cup 3 to produce a smaller total cup size than that shown in FIG. 1, yet still maintaining a proper-fitting and smooth contour to the brassiere cup.

FIG. 1-B shows inner cup 3 overlaying a lesser portion of the inner area of the wide stretchable outer band 1 due to the positioning of attaching hook 10 onto the lowest attaching position of the multiple attaching means 8 of band 1, resulting in a greater volume and total cup size of the two elements 1 and 3 than that shown in FIG. 1. Wide outer band 1 is thus exerting a greater degree of stretchability to act in concert with inner cup 3 to produce a larger total cup size than that shown in FIG. 1, yet again maintaining, in this different variation of total cup size, a proper-fitting and smooth contour to the brassiere cup.

An important feature of the present invention is the great degree of flexibility which derives from the construction of the brassiere in which both the wide stretchable outer bands 1 and 2 and the inner cups 3 and 4 are attached to the bottom area of the body-encircling band 11 at points 18, 19, 20, 21 and 22, while inner cups 3 and 4 are sewn in abutment to band 11 at 25. By attaching the two elements, stretchable bands 1 and 2 and inner cups 3 and 4, at such a low point on the encircling brassiere construction, maximum flexibility of the two elements acting in concert is achieved resulting in the smoothly-contoured variation in cup size which is the novel feature of the present invention. Should the two elements, stretchable bands 1 and 2 and inner cups 3 and 4 be attached to the body-encircling band 11 at mid-joint or higher in the vertical dimension of the bands 1 and 2 and inner cups 3 and 4, the degree of stretchability and flexibility of the two elements would be so diminished that they would no longer be capable of acting in concert to create a variation in total cup size as is accomplished in the construction of the present invention.

FIG. 2 further illustrates the action of the two elements bands 1 and 2 and inner cups 3 and 4 in creating the variation in total cup size resulting from the action in concert of said two elements. FIG. 2 is a combined sectional view of section 6—6 of FIG. 1, 7—7 of FIG. 1-A and 5—5 of FIG. 1-B. Section 6—6 represents the configuration of the normal cup size of the brassiere in which the attaching means are located in the middle attaching position, section 7—7 shows the configuration resulting from the attaching means being located at the top attaching position and forming thus a cup size smaller than that shown in section 6—6; and section 5—5 showing a configuration resulting from the attaching means being located at the bottom attaching position and therefore achieving a cup size greater than that shown in section 6—6. For clarity, only the outer edge of band 1 is shown in the three positions.

In FIG. 3 a preferred embodiment of the multiple attaching means is shown, a new and novel attaching means 8 which is designed to be used in conjunction with conventional hooks as shown by 10 to form a series of pockets to receive insertion of said hooks, thus allowing adjustments in the total brassiere cup size as previously disclosed, as well as attaching and detaching the inner cups 3 and 4 from the outer bands 1 and 2 for the purpose of infant nursing.

Multiple attaching means 8 consists of a band of tape material which is folded in sequence and sewn together in a manner known in the industry as "ruching" so as to form a vertical series of pockets into which hooks 10 which are permanently attached to the apices of inner cups 3 and 4 may be attachably inserted into or detached from said pockets of the multiple attaching means 8 which are permanently attached to the apices of the wide stretchable outer bands 1 and 2.

FIG. 4 illustrates one of many alternative multiple attaching means for the efficient functioning of the basic novel construction of the maternity brassiere herewith. Multiple attaching means 9 consists of a series of metal "eyes" which are sewn in permanent attachment to a tape material such attaching means being a standard item well known in the brassiere industry. In addition to the alternative multiple attaching means as indicated in 9, the scope of the present invention is not to be restricted to such means, but can be one of many systems of fasteners well known in the art, such as VELCRO, snaps, hooks and eyes, buttons, slide fasteners, etc.

What is claimed is:

1. In a maternity brassiere, inner breast-supporting cups joined together in the bottom center area of the brassiere and also joined in abutting relation to each of the side portions of a partially body-encircling band having lateral adjustable means in the rear, said inner cups overlaying the inward portion of wide stretchable bands which cover the periphery of the upper portion of each breast, said inner cups and said wide stretchable bands acting in concert in such manner as to expand or contract in conformance with the expansion or contraction of the breasts of the wearer during pregnancy and after birth, said wide stretchable bands being affixed to the bottom region of the brassiere at the sides and in the center thereof, a pair of shoulder straps connected in the rear to said partially body-encircling band and in the front to the apices of said wide stretchable bands.

2. A maternity brassiere as set forth in claim 1 in which the manner and degree of expansion and contraction of the two elements of the total brassiere cup composed of the inner breast-supporting cups overlaying the wide stretchable bands is determined by a single attaching means affixed to the apices of the inner cups, and receptive multiple attaching means affixed to the apices of the wide stretchable bands.

3. A maternity brassiere as set forth in claim 2 in which the receptive multiple attaching means permanently affixed to the apices of the wide stretchable bands is formed in a series of vertical receiving means for attachment and detachment of the single attaching means permanently affixed to the apices of the inner breast-supporting cups, resulting in a different configuration of the combined total cup size when the single attaching means on the apices of the inner cups is attached at either a higher or lower point onto one of the series of vertical receiving means affixed to the apices of the wide stretchable bands.

4. A maternity brassiere as set forth in claim 3 in which the receptive multiple attaching means permanently affixed to the apices of the wide stretchable bands consists of a vertical series of pleated and sewn pockets constructed from a band of tape material which is folded in sequence and sewn together in a manner known in the industry as "ruching" so as to form a vertical series of pockets into which the single attaching means on the apices of the inner cups consisting of a hook element may be attachably inserted into or detached from said pockets of the receptive multiple attaching means, so as to achieve a greater or lesser total cup size of the two elements of said total cup in accordance with the vertical position of attachment of said single hook element to one of the series of pockets thus formed, and so as to permit the inner cup of said two cup elements to be detached and lowered to permit exposure of the breast of the wearer for infant nursing.

* * * * *